US010036163B1

(12) United States Patent
Paulsen

(10) Patent No.: US 10,036,163 B1
(45) Date of Patent: Jul. 31, 2018

(54) SEISMIC PERIMETER ATTACHMENT CLIP

(71) Applicant: USG Interiors, LLC, Chicago, IL (US)

(72) Inventor: Mark R. Paulsen, Beach Park, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/663,999

(22) Filed: Jul. 31, 2017

(51) Int. Cl.
*E04B 9/30* (2006.01)
*E04B 9/12* (2006.01)
*E04B 1/98* (2006.01)

(52) U.S. Cl.
CPC ..... *E04B 9/30* (2013.01); *E04B 1/98* (2013.01); *E04B 9/127* (2013.01)

(58) Field of Classification Search
CPC ..... E04B 9/30; E04B 1/98; E04B 9/127
USPC ..... 52/167.1, 167.4, 272, 283, 506.06, 52/506.07, 506.08
See application file for complete search history.

(56) References Cited

U.S. PATENT DOCUMENTS 3,798,865 A * 3/1974 Curtis ..... E04B 9/127 403/189
4,531,340 A * 7/1985 Sauer ..... E04L 39/10 403/393
5,046,294 A 9/1991 Platt
5,966,887 A * 10/1999 Mieyal ..... E04B 9/122 52/506.07
7,293,393 B2 * 11/2007 Kelly ..... E04B 9/067 52/167.1
7,552,567 B2 * 6/2009 Ingratta ..... E04B 9/06 52/506.05
7,614,195 B2 * 11/2009 Platt ..... E04B 9/064 52/506.06
7,673,429 B2 * 3/2010 Frecska ..... E04B 9/127 403/187
8,413,402 B2 * 4/2013 Sareyka ..... E04B 9/068 52/506.07
8,453,407 B2 * 6/2013 Tedesco ..... E04B 9/127 52/167.1
8,615,948 B2 * 12/2013 Underkofler ..... E04B 9/067 52/506.06
9,809,976 B2 * 11/2017 Sareyka ..... E04B 9/127
2005/0160696 A1 * 7/2005 Kelly ..... E04B 9/067 52/712

(Continued)

FOREIGN PATENT DOCUMENTS

JP 2005214004 A * 8/2005 ..... E04B 9/067

*Primary Examiner* — Brent W Herring
(74) *Attorney, Agent, or Firm* — Pearne & Gordon LLP

(57) ABSTRACT

Seismic perimeter attachment clip for attaching a grid runner to wall molding comprising sheet metal base and slide elements, the base having a tab constructed and adapted to be secured with a screw to the wall molding and having a projection extending perpendicularly from the base, the slide being constructed and adapted to be attached to a grid runner, the base and slide providing a cam surface and a cam follower surface, the surfaces being mutually indexable to a home position, the cam surface being configured to raise the slide and an attached grid runner from an elevation at the home position when the slide is extended from the tab in response to longitudinal movement of the attached grid runner whereby an end of the attached grid runner is elevated above a lower flange of the wall molding as the end passes over a distal edge of the lower flange.

10 Claims, 4 Drawing Sheets

(56) References Cited

U.S. PATENT DOCUMENTS

| | | | | |
|---|---|---|---|---|
| 2006/0096219 | A1* | 5/2006 | Ingratta | E04B 9/06 52/506.07 |
| 2007/0180787 | A1* | 8/2007 | Fecska | E04B 9/127 52/506.06 |
| 2008/0060306 | A1* | 3/2008 | Platt | E04B 9/064 52/506.06 |
| 2011/0146194 | A1* | 6/2011 | Tedesco | E04L 9/30 52/665 |
| 2011/0283634 | A1* | 11/2011 | Underkofler | E04B 9/067 52/167.1 |
| 2012/0047836 | A1* | 3/2012 | Sareyka | E04B 9/068 52/506.06 |
| 2014/0144099 | A1* | 5/2014 | Sareyka | E04B 9/068 52/704 |
| 2014/0352249 | A1* | 12/2014 | Jankovec | E04B 9/127 52/665 |
| 2017/0009451 | A1* | 1/2017 | Sareyka | E04B 9/068 |
| 2017/0226736 | A1* | 8/2017 | Lehane | E04L 9/34 |

* cited by examiner

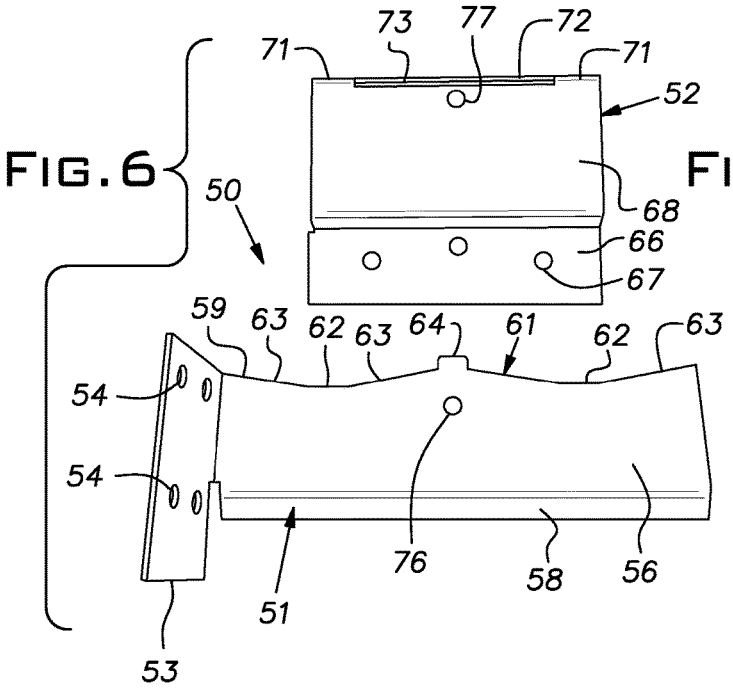
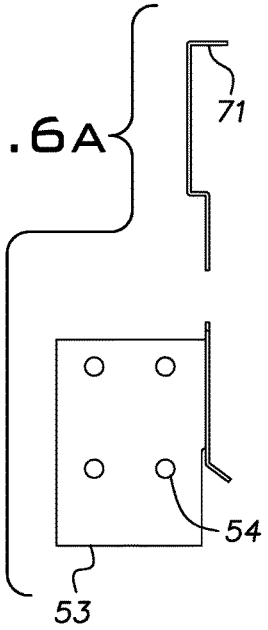
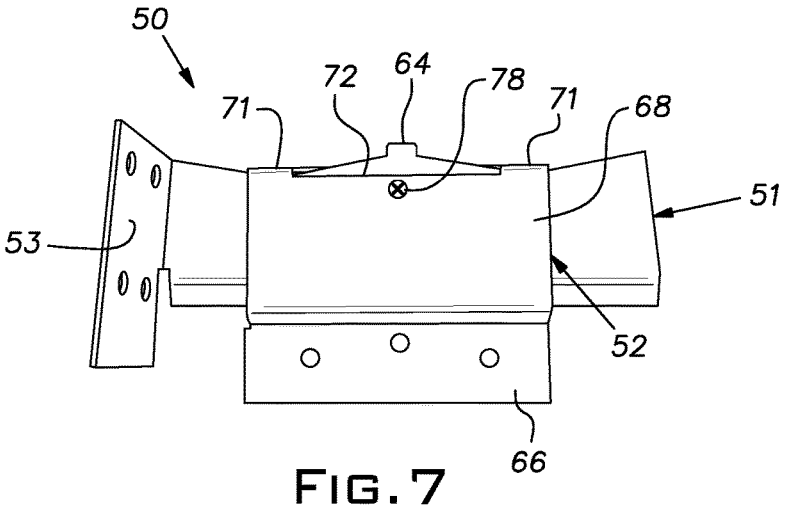
FIG. 7

SEISMIC PERIMETER ATTACHMENT CLIP

BACKGROUND OF THE INVENTION

The invention relates to accessories for suspended ceiling grid construction and, in particular, to a seismic clip for stabilizing the grid members.

PRIOR ART

U.S. Pat. Nos. 5,046,294, 7,293,393, 7,552,567 and 8,453,407 are examples of seismic clips used to limit movement of the ends of grid runners at the perimeter of a suspended ceiling grid. There remains a need for an improved seismic clip that is versatile and reliable in its function of supporting and protecting grid runners during a seismic event.

SUMMARY OF THE INVENTION

The invention provides a seismic clip for suspended ceiling grid runners that offers high strength, rigidity and versatility while improving the ability of the clip to afford a full range of grid movement during a seismic event.

The inventive clip is arranged to precisely lift the end of an attached grid runner during a seismic event so that a risk of a collision between a displaced end of the grid runner swinging back towards a wall molding is reduced.

When installed and under normal static conditions, a grid runner, typically a tee, lies on the top of the horizontal leg of a wall angle or flange of a wall channel. Hereinbelow, the term "wall molding" will include both wall angles and wall channels and the term "flange" will mean either wall angle leg or wall channel flange. In a seismic event, a suspended ceiling grid can shift or swing horizontally so that the edge of a grid runner end moves outward from the outer edge of the wall molding flange. On return movement of the grid runner, it is imperative that the edge of the grid runner end is above the outer edge of the wall molding flange in order to avoid a collision. The clip of the invention assures a precise positive lift of the grid runner from an installed elevation when the end of the grid runner approaches or is in a position directly overlying the wall molding flange. The clip is an advance over prior art clips that fail to reliably guide a grid runner end over the wall molding flange.

In the several disclosed embodiments of the invention, the clip is a two-part device, stamped from sheet metal, each part including one of a pair of mating cam and cam follower elements. Preferably, a support base part fixed to a wall provides the cam and a slider fixed to a grid runner provides the cam follower. The cam surfaces in the disclosed embodiments are bidirectional. This cam configuration serves to dampen oscillation and tends to be self-centering during a seismic event. By providing both cam and follower surfaces on the clip parts or elements, greater precision in control of the position of a grid runner relative to a wall molding is obtained.

BRIEF DESCRIPTION OF THE DRAWINGS

FIG. 6 is an exploded side perspective view of a second embodiment of the inventive clip;

FIG. 6A is an exploded end view of the clip of FIG. 6;

FIG. 7 is an assembled side perspective view of the clip of FIG. 6;

DESCRIPTION OF THE PREFERRED EMBODIMENTS

Figure 1:
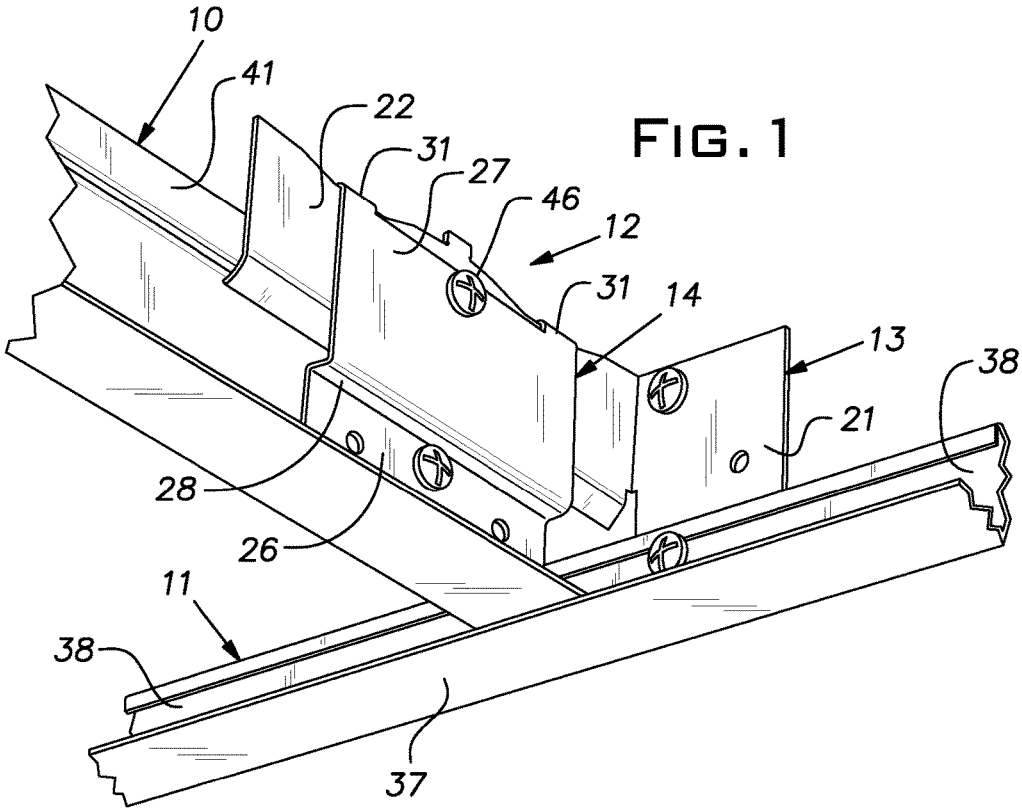
FIG. 1 is a perspective view of a grid runner end intersecting a wall molding fitted with a first embodiment of a clip of the invention.
Figure 2A:
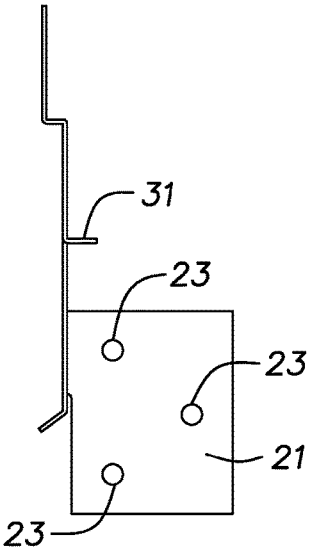
FIG. 2A is a side view of the intermediate configuration of the clip of FIG. 1.
Figure 2:
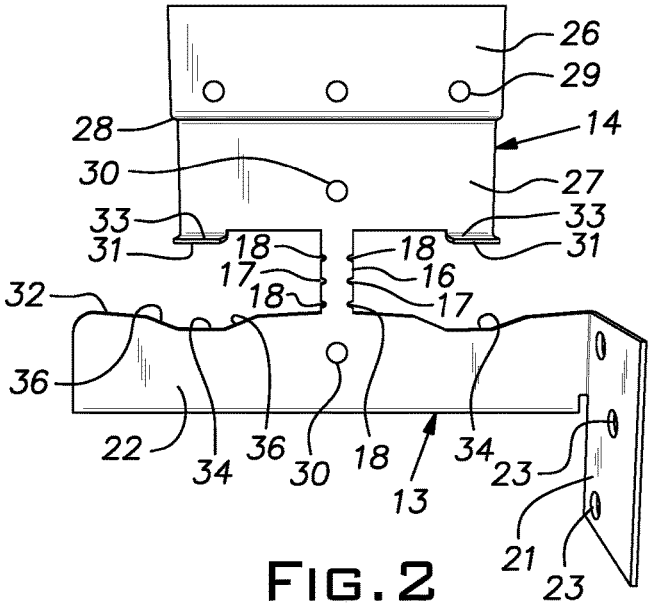
FIG. 2 is a perspective view of an intermediate configuration of the clip of FIG. 1.

FIG. 1 illustrates portions of a grid runner or grid tee 10 intersecting a wall molding angle 11 at the perimeter of a suspended ceiling. The grid runner 10, typically having the cross-section of an inverted tee, is anchored to a wall and/or the wall molding 11 by a clip assembly 12, sometimes simply referred to as a clip hereinafter. The clip 12, when full installed, is in two separate parts, namely, a base 13, and a slide 14. Both parts 13, 14 of the clip 12, as indicated in FIG. 2, can be blanked from a single sheet of metal, i.e. 20 gauge hot dipped galvanized (HDG) steel with the parts initially integral with a common bridge or strap 16. The clip 12 is folded at the middle of the strap 16 to bring the parts 13, 14 into abutment. The strap 16 can be provided with pairs of opposed notches, one pair 17 favoring a fold at the strap center and other pairs 18 to later mark a cutting line. When folded, the strap 16 maintains the parts 13, 14 in proper registration and alignment with one another.

The base 13 includes a mounting plate or tab 21 and a projection 22 at right angles to the mounting plate. The mounting plate, preferably, is flat and includes several holes 23 for receiving screws or other fasteners used to secure the base 13 to a wall molding 11 or wall. As indicated in FIG. 2, the slide 14 has a generally rectangular profile in side view. The slide 14 has two planar vertical sections 26, 27 separated by an intermediate horizontal offset section 28. Holes 29, 30 are stamped or otherwise formed in the sections 26, 27 for receiving fasteners, typically self-drilling screws.

Tabs 31 at opposite ends of the slide 14 are bent out of the plane of the section 26. The slide 14 is abutted against the base projection 22 by folding the strap 16 on a line between the notches 17. With the slide 14 abutting the base 13, the tabs 31 initially project over an upper edge of the projection 22 and are thereafter pressed down flat towards the projection.

An upper edge surface 32 of the projection 22 serves as a cam for lifting and lowering the slide 14 in response to horizontal slide movement relative to the projection. The lower or inner surfaces 33 of the slide tabs 31 in contact with the projection upper edge 32 serve as cam followers. FIG. 2 most clearly illustrates the cam profile of the projection upper edge 32. The cam profile, preferably, is duplicated on opposite sides of the strap 16. The cam profile has two low spots 34, with a spacing corresponding to the spacing between the tabs 31. Inclined rise zones 36 exist on each side of a low spot 34. When the tab surfaces 33 rest on the surfaces of the low spots 34, the slide 14 is centered in a normal position on the base projection 22. This position is automatically established and maintained by constraints of the strap 16.

As customary in a suspended ceiling grid installation, a grid runner or grid tee 10 is cut so that its end edge lies over the horizontal leg or flange, designated 37 and is spaced from the vertical web or leg, designated 38, of the wall molding.

The base mounting plate 21 can be installed behind or in front of the wall molding 11. If a wall stud is available, one or more screws inserted in the tab holes 23 are used to fix the clip 12 to the stud and wall molding 11, otherwise the tab can be similarly fixed to the wall molding alone.

With the base 13 fixed to the wall, the grid runner 10 resting on the wall molding flange 37 and the slide 14 properly indexed with the tab surfaces 33 resting on the surfaces of the cam low spots 34, the slide 14 is fixed by the installer to the grid runner 10 by driving self-drilling screws or other fasteners through the preformed holes 29 into a web of the grid runner 10. The offset 28 allows the slide section 26 to be abutted against the grid tee web and provides clearance of the section 27 with a reinforcing bulb 41 of the grid tee 10 and the base projection 22.

Under these set-up, static conditions, the relative positions of the grid tee, wall molding, clip base and clip slide are precisely determined, there being no vertical clearance between cam follower surfaces 33 and the cam surfaces 34 when the grid runner 10 rests on the wall molding flange 37. Next, the upper end of the folded strap 16 can be clipped at the pair of notches 18 to separate or uncouple the slide 14 from the base 13. If desired before clip installation and before the strap 16 is severed (or if no strap is provided as with clips discussed below), the slide 14 can be indexed to the base 13 with a screw 46 through the preformed holes 30 in the slide 14 and base projection 22. The strap 16 can be severed and the clip can then be installed. After the clip 12 is installed on the grid tee 10 the screw 46 indexing the slide to the base can be removed.

The vertical edge of the slide 14 can be aligned with the end of the grid runner 10.

The word "index" (and derivative words) is used herein to mean that relative parts are properly aligned and registered for proper functionality.

Figure 3:
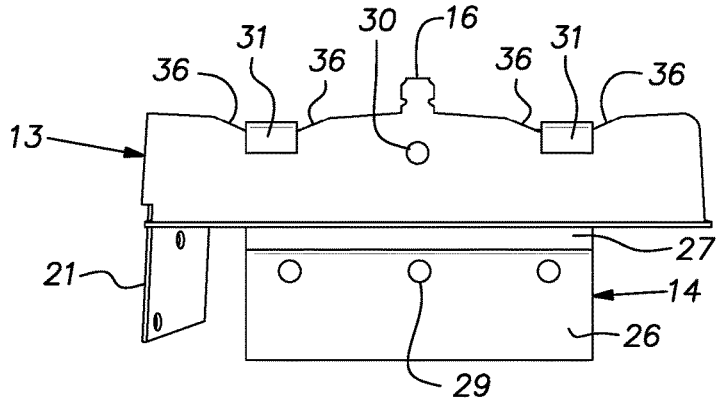
FIG. 3 is a perspective side view of the clip of FIG. 1 in a centered or "home" position.
Figure 4:
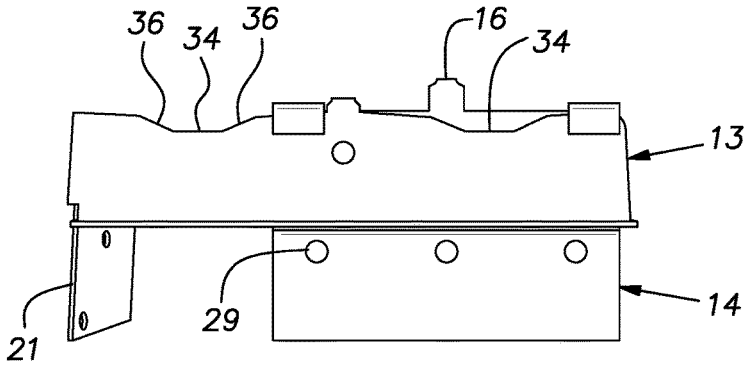
FIG. 4 is a perspective side view of the clip of FIG. 1 in an extended position.
Figure 5:
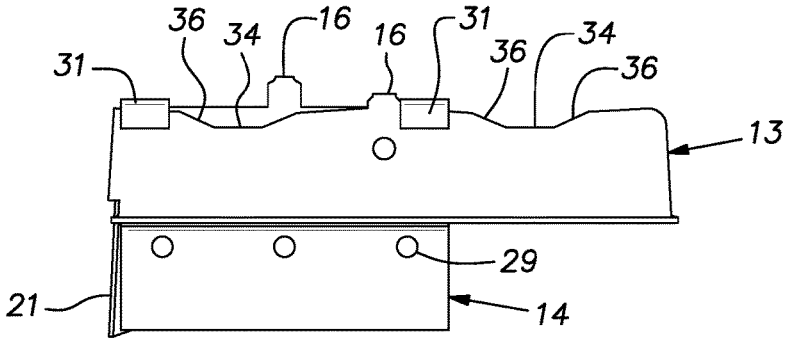
FIG. 5 is a perspective side view of the clip of FIG. 1 in a compressed position.

With reference to FIGS. 3 and 4, if the slide 14, understood to be attached to a grid runner 10, is pulled away by the grid runner from the wall and base 13 during a seismic event, the slide and grid runner will be raised a vertical distance determined by the slope of each inclined cam surface 36 as "followed" by each tab or follower surface 33 and the horizontal displacement of the slide. As shown in FIG. 4, horizontal movement of the slide 14 is limited when the tab 31 proximal to the wall engages the residual of the strap 16 which serves as a stop on the base projection 22. When the ceiling grid rebounds and the grid runner 10 moves back towards the wall, the cam surface 36 positively holds the slide 14 up so that the end of the associated grid runner is spaced above the distal edge of the wall molding flange 37. Therefore, the risk of collision between these elements is reduced, if not eliminated. In the event that the ceiling grid swings back towards the wall, the slide 14 and grid runner 10 will be stopped by engagement of the outer or distal tab 31, and the strap 16, as depicted in FIG. 5.

The V-shaped or valley shaped cam profile associated with each slide tab 31 serves to dampen oscillation of the grid area associated with the respective grid runner and tends to bias the slide 14 and its grid runner 10 to their originally installed positions.

FIGS. 6, 6A and 7 illustrate a second embodiment of a clip 50 having a base 51 and a slide 52 both stamped or otherwise formed of sheet metal. The base includes a flat mounting tab 53 with holes 54 for screws for attachment to a wall and/or wall molding. A projection 56 of the base 51 is integral with and extends at a right angle to the mounting tab 53. The projection 56 having a flat main portion 57 is stiffened by a narrow flange 58 extending along a lower edge of the main portion and out of the plane of the main portion.

An upper edge 59 of the projection 56 has two cam surface areas 61 analogous to those of the clip 12 previously described. Each cam 61 has a central home zone 62 that is lowermost and rise or inclined zones 63 on either side of the home zone. The cam areas 62, 63 are separated by a stop 64 analogous to the strap 16 of the clip 12.

The slide 52 includes a flat lower portion 66 with holes 67 for attaching it to the web of a grid runner 10 with screw fasteners or the like. An upper flat portion 68 has spaced cam follower surfaces 69 on lower sides of tabs 71 bent at right angles to the upper portion 68. Distal ends of the tabs 71 are joined by a strap 72 that is spaced horizontally a distance from the upper portion 68 so that a slot 73 exists for reception of the stop 64.

Holes 76, 77 in the base 51 and slide 52, respectively, are aligned and receive a common screw 78 to index these parts to a home or center position relative to each other as illustrated in FIG. 7. The clip 50 is installed and operates in the manner generally as described for the clip 12. Once the clip 50 is installed between a wall molding and grid runner, the indexing screw 78 is removed.

Figure 8:
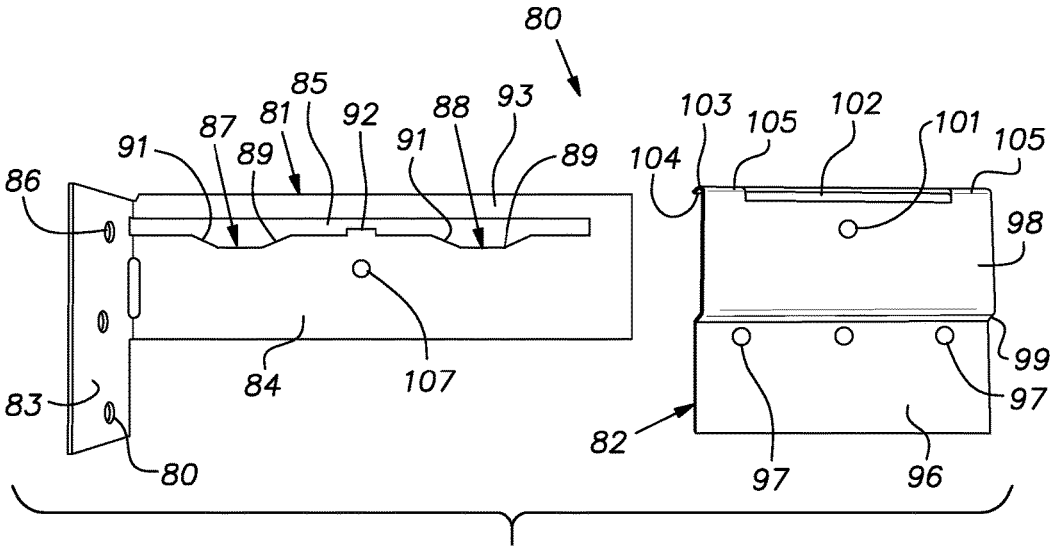
FIG. 8 is an exploded perspective side view of a third embodiment of the inventive clip.
Figure 9:
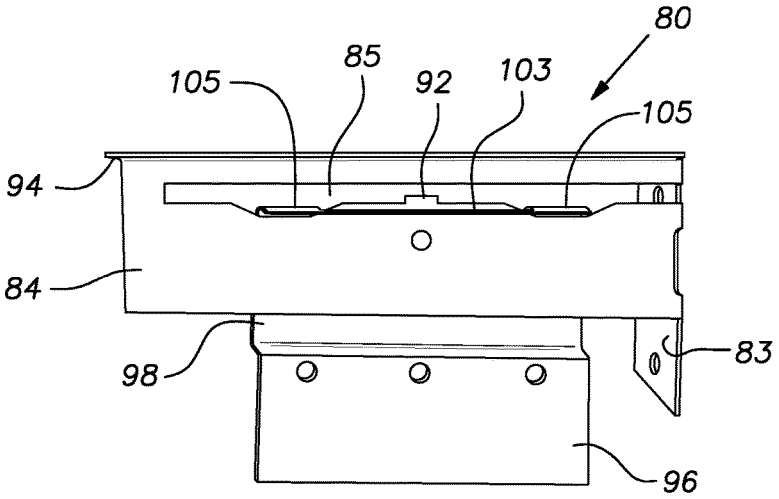
FIG. 9 is an assembled side perspective view of the third embodiment of the clip taken at a side opposite that of FIG. 8.

FIGS. 8 and 9 illustrate a third embodiment of the inventive clip, designated 80. The clip 80 is an assembly of a base 81 and a slide 82, each preferably stamped from sheet metal. The base 81 includes a mounting tab or plate 83 and a projection 84 extending perpendicularly to the plate. The mounting tab 83 is provided with holes 86 for reception of screws that fasten the tab to a wall or wall molding, either behind or in front of the vertical leg or web of the wall molding. The projection 84 has an elongated rectangular profile in side view. In an upper section, the projection 84 has a slot 85 forming spaced cam surfaces 87, 88 that have duplicate profiles. Each cam surface 87, 88 has a central lower home surface 89 and inclined surfaces 91 on each side of the home surface.

A stop 92 is situated between and projects above the cam surfaces 87, 88. An upper strip 93 of the projection 84 extends along the slot 85 and has a lengthwise flange 94 bent out of the plane of the projection that serves to stiffen the projection. One end of the strip 93 is joined to the tab 83 and an opposite end is joined to a distal part of the projection.

The slide 82 has a flat bottom section 96 with holes 97 for screws to affix the slide to the web of a grid runner 10. A flat upper section 98, joined to the bottom section by an offset 99, has an indexing hole 101, an elongated slot 102, and a flange 103. Lower surfaces 104 of land areas 105 at each end of the flange 103 serve as cam followers.

FIG. 9 illustrates the clip 80 in an assembled condition where the flange 103 is on a side of the projection 84 opposite the side where the upper slide section 98 is located. When a screw is located in holes 101, 107, the slide 82 is indexed to a home position relative to the base projection 84.

When mounted to a grid member and wall molding as described in connection with the clip 12, a displacement of the slide 82 relative to the base 81 in either longitudinal direction of the grid runner will result in the grid runner being raised above the wall molding flange by interaction between the cam surfaces 87 and the cam follower surfaces

104. The strip 93 can restrain the slide 82 so that the land areas 105 remain in the slot 85 during violent seismic activity.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A seismic perimeter attachment clip for attaching a grid runner to wall molding comprising sheet metal base and slide elements, the base having a tab constructed and adapted to be secured with a screw to the wall molding and having a projection extending perpendicularly from the tab, the slide being constructed and adapted to be attached to a grid runner, the base and slide providing a cam and a cam follower, the cam and follower being mutually indexable to a home position, the cam being configured to raise the slide and an attached grid runner from an elevation at the home position when the slide is extended from the tab in response to longitudinal movement of the attached grid runner whereby an end of the attached grid runner is elevated above a lower flange of the wall molding as the end passes over a distal edge of the lower flange, said cam and follower being arranged to raise said slide and grid runner when said grid runner compresses said slide toward said tab.

2. A seismic perimeter attachment clip as set forth in claim 1, wherein said cam is provided by said projection and said cam follower is provided by said slide.

3. A seismic perimeter attachment clip as set forth in claim 1, wherein said base and slide are stamped from a single metal sheet and joined by a common strap, the strap being folded to maintain said base and slide in abutment and mutually indexed.

4. A seismic perimeter attachment clip as set forth in claim 3, wherein the strap is notched at a fold line.

5. A seismic perimeter attachment clip as set forth in claim 1, wherein the cam has profile sections on opposite sides of the home position, each of said profile sections being arranged to elevate the slide.

6. A seismic perimeter attachment clip as set forth in claim 1, wherein the element providing the cam includes a stop for limiting horizontal movement of the slide.

7. A seismic perimeter attachment clip as set forth in claim 1, wherein the slide and projection have alignable holes for receiving a common screw for purposes of indexing the slide to the base in said home position.

8. A seismic perimeter attachment clip as set forth in claim 1, wherein the cam is an edge surface of a profile of the projection.

9. A seismic perimeter attachment clip for attaching a grid runner to wall molding comprising sheet metal base and slide elements, the base having a tab constructed and adapted to be secured with a screw to the wall molding and having a projection extending perpendicularly from the tab, the slide being constructed and adapted to be attached to a grid runner, the base and slide providing a cam and a cam follower, the cam and follower being mutually indexable to a home position, the cam being configured to raise the slide and an attached grid runner from an elevation at the home position when the slide is extended from the tab in response to longitudinal movement of the attached grid runner whereby an end of the attached grid runner is elevated above a lower flange of the wall molding as the end passes over a distal edge of the lower flange, the cam follower being a surface of the slide on a portion of the slide bent out of a plane of a major portion of the slide.

10. A seismic perimeter attachment clip as set forth in claim 9, wherein a profile of the cam has two spaced low spots corresponding to the home position and the slide has two cam follower parts.

* * * * *